United States Patent [19]

Drobot

[11] Patent Number: 4,823,425

[45] Date of Patent: Apr. 25, 1989

[54] CHIMNEY FLUE BRUSH

[76] Inventor: Alan J. Drobot, 449 Trent Avenue, Winnipeg, Manitoa, Canada, R2G 1K1

[21] Appl. No.: 103,290

[22] Filed: Oct. 1, 1987

[51] Int. Cl.[4] ..... F23J 3/00

[52] U.S. Cl. ..... 15/162; 15/242

[58] Field of Search ..... 15/160, 162, 163, 242, 15/243, 249, 104.16; 98/46; 126/16; 166/170, 175

[56] References Cited

U.S. PATENT DOCUMENTS

| | | | |
|---|---|---|---|
| 1,361,708 | 12/1920 | Garretson | 15/249 |
| 1,545,355 | 7/1925 | Roth | 15/243 |
| 1,627,045 | 2/1926 | McGeehin . | |
| 1,758,950 | 9/1927 | Hunecke . | |
| 1,910,358 | 3/1932 | Olson . | |
| 2,129,091 | 6/1937 | Jacobson . | |
| 2,157,493 | 5/1939 | Miller et al. | 15/243 |
| 2,170,997 | 5/1936 | Griffin . | |
| 3,790,983 | 2/1974 | Whitsett . | |
| 4,583,258 | 4/1986 | Carroll | 15/249 |

FOREIGN PATENT DOCUMENTS

| | | | |
|---|---|---|---|
| 180349 | 11/1954 | Austria | 15/162 |
| 5876 | 6/1879 | Fed. Rep. of Germany | 15/243 |
| 393888 | 2/1922 | Fed. Rep. of Germany | 15/242 |
| 2155733 | 5/1973 | Fed. Rep. of Germany | 15/243 |
| 1191196 | 4/1959 | France | 15/162 |
| 284732 | 4/1931 | Italy | 15/243 |
| 33 | of 1886 | United Kingdom | 15/243 |
| 1997 | of 1890 | United Kingdom | 15/249 |

*Primary Examiner*—Harvey C. Hornsby
*Assistant Examiner*—Joseph S. Machuga
*Attorney, Agent, or Firm*—Adrian D. Battison; Stanley G. Ade; Murray E. Thrift

[57] ABSTRACT

A brush for cleaning a chimney flue is formed from a central hub outwardly from which extends a plurality of plastics strips manufactured from strapping tape having a width of the order of ½ inch and a thickness of the order of 0.030 inch. The device is manufactured from a plurality of separate units each formed with six outwardly extending strips or blades and a central hub with all of the units stacked on a bolt and prevented from rotation each relative to the next. A natural curvature of the strips tends to form a device into a cone shape so they can be readily pressed into a chimney flue from the lower end with the flexibility of the strapping tape enabling the unit to be compressed and passed around obstructions such as the flue damper.

12 Claims, 3 Drawing Sheets

CHIMNEY FLUE BRUSH

BACKGROUND OF THE INVENTION

This invention relates to a chimney flue brush.

Chimneys particularly of wood and other solid fuel burning type necessarily include a chimney flue which allows the escape of the hot combustion gases. As is well known these gases condense on the chimney flue and leave deposits of carbon and creosote which must be regularly removed. The tendency is of course as in any other maintenance operation for this to be overlooked or carried out infrequently with the significant danger of chimney fires and at least the more rapid deterioration of the chimney flue construction.

The brushes which have generally been available to date are of the type including a twisted wire core with the plurality of bristles which extend outwardly to either side of the core and are held in place by being clamped between the twisted wire of the core. The bristles in most cases are of a wire construction which is flexible to some extent but if overflexed will deform thus limiting the amount of compression which can be applied to the brush. The wire bristles of course give a very vigorous brushing action to the inside of the flue and in many cases this brushing action can be too vigorous in that it can scratch the surface for example of a stainless steel flue. This scratching will itself further promote deposits to become attached to the surface and will accelerate the deterioration of the flue. As the bristles are relatively stiff and have a very limited resilience, it is necessary to match fairly closely the size of the brush that is the outside dimension of the brush to the dimension of the flue so the proper scrubbing action is obtained without the danger of the brush becoming stuck. It is also very difficult because of the rigidity of the bristles to reverse the brush. That is, as the brush is being drawn through the flue it tends to form a cone shape and once in the shape it is very difficult to reverse into a cone of the other direction and hence the brush can become jammed within the flue. A yet further problem which arises is that of attempting to get the brush past the damper or other obstructions since its flexibility is very limited. It is also possible for the stiff wire bristles to pull mortar from the flue construction thus again accelerating deterioration.

A further type of construction of chimney brush which is currently available is very similar to that of the metal wire construction described above but in which the metal wire bristles are replaced with synthetic bristles which are thus more flexible. This device alleviates some of the problems which arise with the above metal bristle type but still is generally unsatisfactory. The number of cleanings which are available with a device of this type are also more limited due to the increased likelihood of damage to the bristles.

A yet further device for cleaning chimney flues is of a type including a plurality of flat discs which are mounted upon a central hub with a disc basically being shaped to the inside surface of the flue so that the discs are pulled along the flue and scrape the surface. Devices of this type are of course very rigid in construction and thus difficult or impossible to manoeuvre past deviations in the flue shape or the damper thus limiting the manner in which cleaning can be effected.

Other devices are shown in U.S. Pat. Nos. 2.129.091 (Jacobson), 1,910,358 (Olson), 2,170,997 (Griffin), 1,627,045 (MoGeehin), 3,790,983 (Whitsett) and 1,758,950 (Hunecke). Most of the above show scraper type devices using variously shaped scraper blades mounted on a central hub.

SUMMARY OF THE INVENTION

It is one object of the present invention, therefore, to provide an improved chimney sweeping device which provides an effective action on the chimney flue but is of a flexible construction and accordingly allows passage past dampers and other obstructions.

According to the invention, therefore, there is provided a brush for cleaning a chimney flue comprising a central hub portion arranged to extend longitudinally of a central axis of the chimney and a plurality of projecting members extending outwardly from the hub portion for engaging an inner surface of the flue, each of the projecting members comprising a strip of a flexible, stiff, plastics material having a width angularly of the axis greater than a thickness longitudinally of the axis and a length radially of the axis greater than the width thereof.

Preferably the device is manufactured from a plurality of strips of plastic strapping material which is generally of the order of ½ inch in width and is cut to a length to manufacture a cleaning device of the required diameter. The flexible plastic strips thus formed have a width at the wall of the flue of the order of ½ inch which has been found to provide a very suitable action on the wall which is not scratching or damaging to the surface and yet carries out an effective cleaning action.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

The brush shown in FIGS. 1 through 4 comprises a plurality of separate units clamped together. Each of the units comprises three strips of plastics strapping material of a type which is generally ½ inch in width and thickness of the order of 0.020 inch to 0.050 inch. Such strapping material generally manufactured from polypropylene is readily available and is supplied in rolls of long length.

Figure 1:
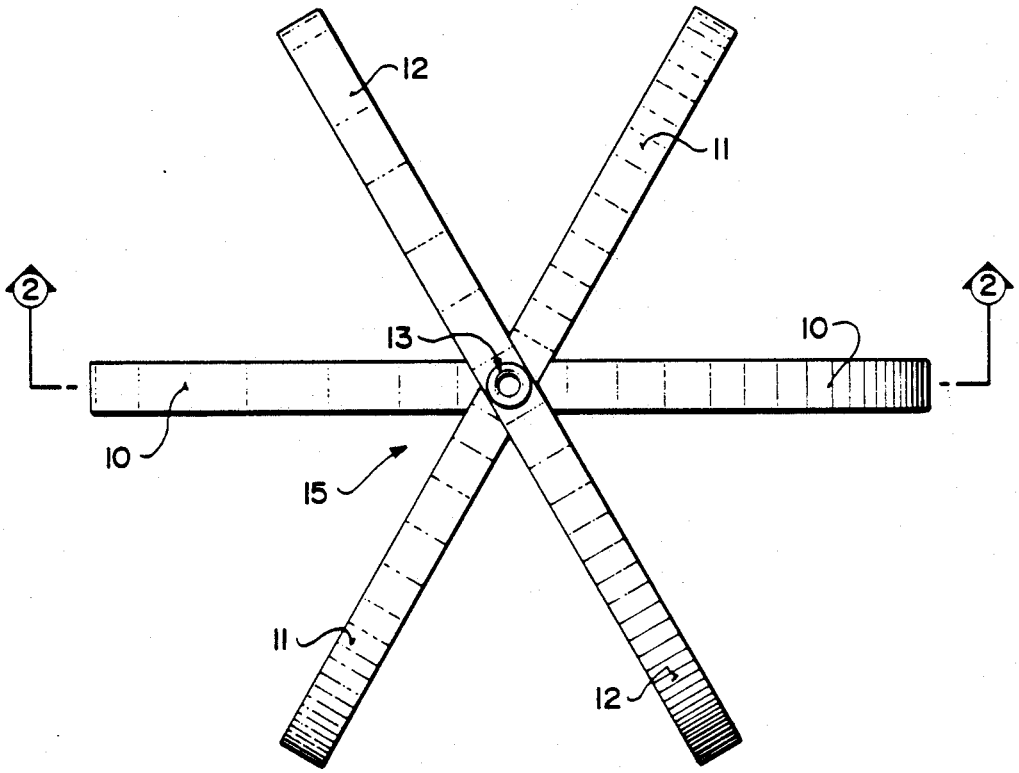
FIG. 1 is a plan view of one section of a flue according to the invention.
Figure 2:
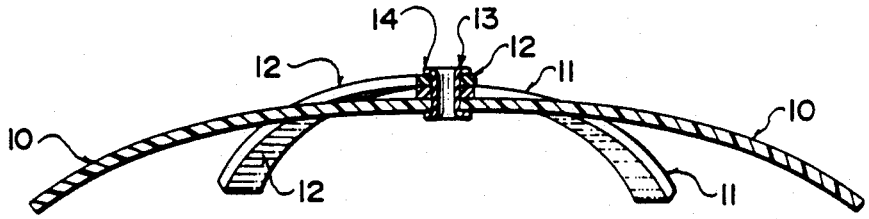
FIG. 2 is a cross sectional view along the lines 2—2 of FIG. 1.

To manufacture one such unit as shown in FIGS. 1 and 2, three such lengths are cut with the length chosen to be the diameter of the finished brush which will in practice be slightly greater than the diameter of the flue which is intended to be cleaned. In practice the diameter and thus the length of the strips can be of the order of ten inches.

Simultaneously with the cutting of the strips to length, a hole is punched centrally of the strip. The strips are then laid directly on top of one another so as to align the holes in the three strips following which an eyelet is placed through the strips at the hole and crimped to close on the top and bottom strips to hold them together in place.

The strips are then rotated around the eyelet to take up the equi-angular positions as shown in FIG. 1 thus giving an angle between each strip and the next of 60°.

As the strip material is drawn from a cylindrical package of the material, it tends to retain a memory of its curvature on the package and thus takes up the curved shape shown in FIG. 2 in which each of the strips curves downwardly out of the radial plane of the eyelet.

As shown in FIGS. 1 and 2 the lowermost strip is indicated at 10, the next or intermediate strip is indicated at 11 and the uppermost strip is indicated at 12. The eyelet is indicated at 13 and is passed upwardly from underneath the lowermost strip through the holes and then is crimped at an upper edge 14 to the hold the strips attached together. The unit generally is indicated at 15.

Figure 3:
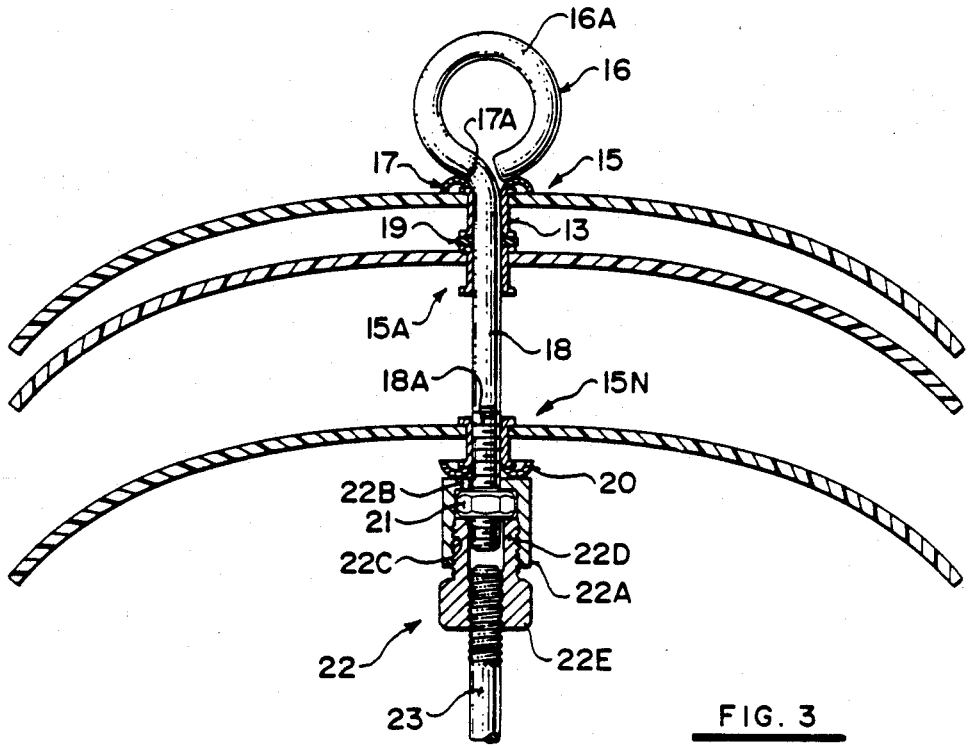
FIG. 3 is a cross sectional view through an assembled cleaning device according to the invention incorporating a plurality of the units of FIGS. 1 and 2.
Figure 4:
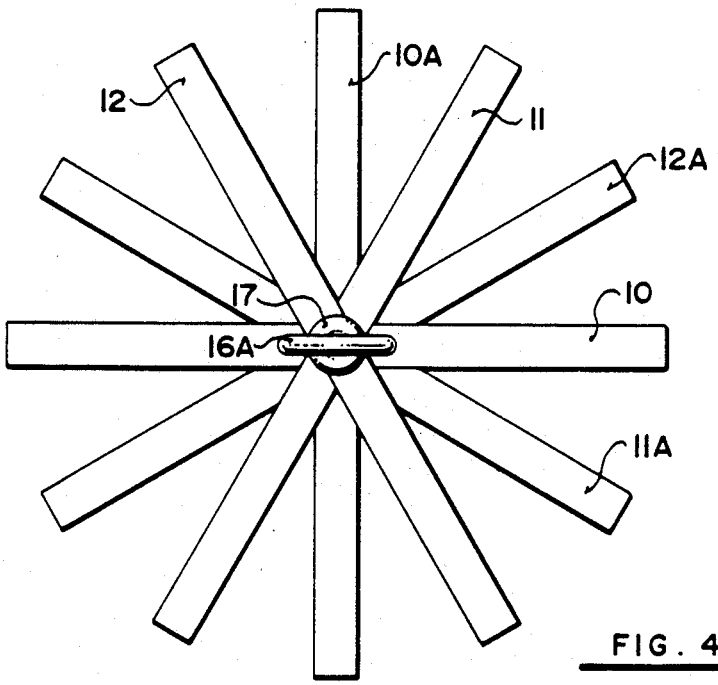
FIG. 4 is a top plan view of the device of FIG. 3.

In assembly of the separate units into a brush, an eye bolt 16 is used as the central support and firstly receives a washer 17 which has an upper recess 17A to engage around the loop 16A of the eye bolt 16. Thus in assembly the washer 17 is placed over a shaft 18 of the eye bolt following which a first one of the units 15 is placed onto the eye bolt so that the eyelet surround the shaft 18 and is a sliding fit thereon. The unit 15 is applied so that the curvature of the strips is in a direction away from the loop 16A as shown in FIG. 3. In the assembly adhesive is placed on the upper surface of the unit 15 between the washer and the unit and also on the underside of the unit at the eyelet. Subsequently a flat washer 19 is applied to the shaft 18 and moved into contact with the underside of the eyelet 13. Further adhesive is applied. A further unit indicated at 15A is then applied over the shaft 18 into contact with the underside of the washer 19 and adhered thereto by the suitable adhesive therebetween. Before the adhesive takes effect, the strips 1OA are rotated angularly relative to the shaft 18 on the eyelet so that they take up position intermediate the strips 10 of the unit 15. In the case of this second unit applied, the rotation will be of the order of 30°. Subsequently the brush is built up by the application of yet further washers 17 and further units 15 with adhesive applied at each position therebetween and the strips of each subsequent unit being turned through an angle so that they do not directly underlie the strips of the next adjacent unit.

Generally the brush will include of the order of sixteen such units each including three strips. After the last unit indicated at 15N, a further washer 20 is applied similar to the washer 17 but inverted relative thereto and pressure applied to the device against the two washers so as to compress all the units together into a minimum height. In practice the height will be of the order of two inches. The compression is then maintained in place by the application of a nut to hold the washer 20 at a required position along the length of the shaft 18. For this purpose the shaft 18 is threaded at its lower end as indicated at 18A and the nut applied to the thread 18A is indicated at 21.

A locking nut and connector assembly is generally indicated at 22 and comprises a first nut 22A which is internally threaded and which includes a lip 22B which holds the nut 21 in place within the nut 22A. A female thread 22C at the outer end of the nut 22A then receives a male portion 22D of a further nut 22E to compress the nut 21 inside the nut 22A. In this way the nut 21 which holds the device in its compressed state is not readily accessible and is not rotated by any action upon either of the nuts 22A or 22E.

The nut 22E can have either a male or female screw thread for receiving the end of a suitable rod 23 by which the brush is applied into the chimney flue.

As each of the strips is manufactured from a flexible plastics material which can bend elastically to a position lying along side the central hub defined by the eye bolt and the nuts, the device is very compressible without damaging in an way the device which will then spring back to take up the cone shape shown in FIG. 3. Thus the device can be used for example on a flue having a diameter substantially equal to the diameter of the device or upon a flue having a very much smaller diameter and furthermore can be manoeuvred past the damper or other obstructions without difficulty since it can be compressed to a relatively small size. In addition these strips will flex back and forth so that the unit can be compressed into a sharper cone angle than that shown in FIG. 3 or the cone can be reversed by bending all of the strips upwardly with each flexing along its length to reduce in outward extent to pass over center as required in the reversing action. These strips are however substantially stiff in that they provide a resistance to bending and are certainly self-supporting and thus when engaging the surface of the flue and are deformed thereby tend to apply a bias force to the inside surface of the flue to scrape the outer flat edge of each strip along the inner surface of the flue.

The flexibility of the device thus enables it to be used from the bottom end of a chimney flue by-passing the damper and any other obstructions at the lower end and thus avoids the necessity for sweeping from the upper end of the flue and the climbing necessary therefore.

Figure 5:
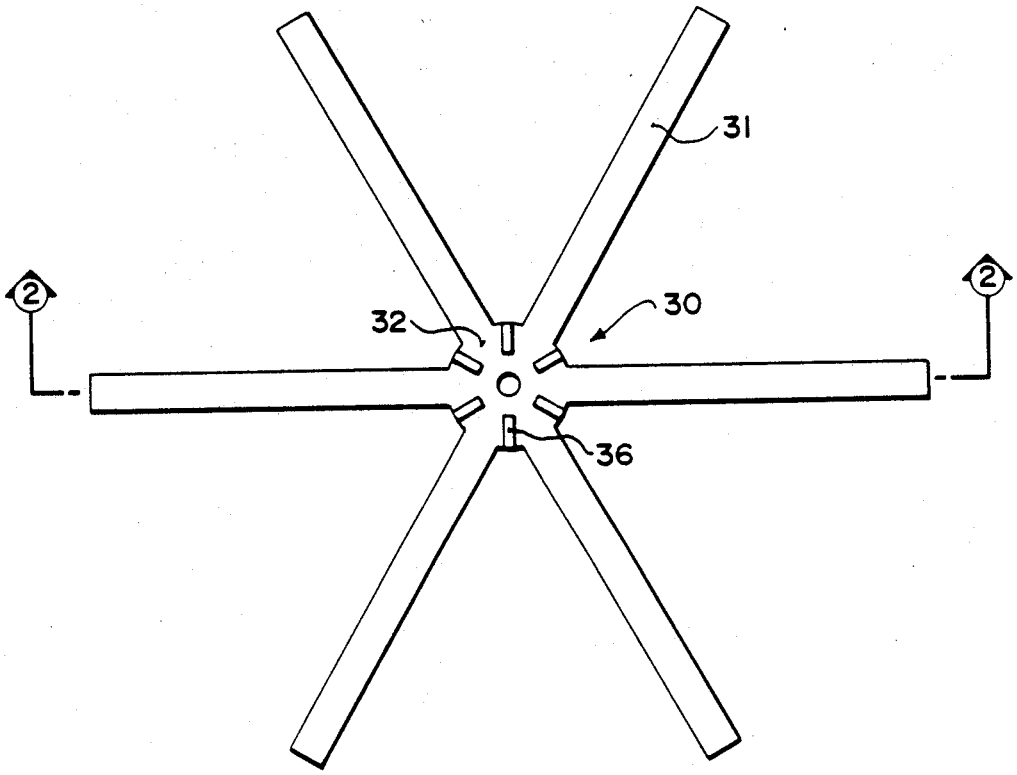
FIG. 5 is a top plan view of an alternative unit for replacing the unit of FIGS. 1 and 2.
Figure 6:
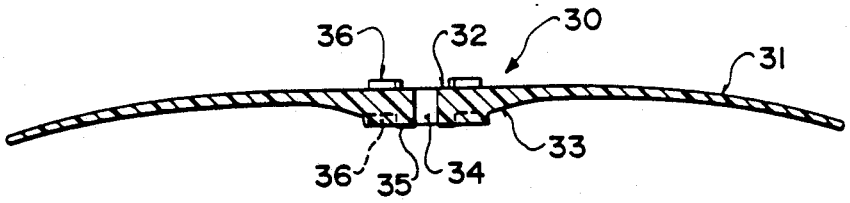
FIG. 6 is a cross sectional view along the lines 6—6 of FIG. 5.

Turning now to FIGS. 5 and 6, the unit of FIGS. 1 and 2 is replaced by a molded unit which has effectively the same properties as the constructed unit of FIGS. 1 and 2. Thus it comprises an integral unit generally indicated at 30 which has six outstanding strips 31 arranged equi-angularly around a central hub 32. Each of the strips 31 is elongate, flat and thin having dimensions previously described in relation to the strips 10. Each strip is arranged to increase in thickness as indicated at the 33 toward a root thereof connected to the hub 32. The hub includes a central opening 34 which can be applied onto the shaft 18 as previously described and an integral raised portion 35 on the underside acting as an integral washer similar to the washers 19 of the unit of FIG. 3. Furthermore both the upper and lower surfaces of the hub include projecting portions 36 which are arranged to interlock with those of the next adjacent hub to prevent rotation of one hub relative to the other so that when set with the strips of one interleaved with the strips of the next adjacent, the strips remain in that interleaved orientation as previously described in relation to FIG. 4.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A brush for cleaning a chimney flue comprising a central hub portion arranged to extend longitudinally of a central axis of the chimney and a plurality of projecting members for engaging an inner surface of the flue, each of the projecting members comprising a strip of flexible plastics material having a width angularly of the axis greater than a thickness longitudinally of the axis and a length greater than the width thereof, said central hub portion and said projecting members being divided into a plurality of separate portions each portion having a central disc and a plurality of said projecting members arranged in the plane of the disc and equiangularly spaced around the disc, said central hub including means mounting said discs together in a stack such that each disc is prevented from rotating relative to a next adjacent disc and such that the projecting members of each disc are angularly offset from those of a next adjacent disc, each said projecting member having a curvature in a direction out of a radial plane of said central axis containing the disc such that each separate portion substantially lies in a cone shape with the portions having their cone shapes all directed in the same longitudinal direction along said central axis wherein each of said projecting members having a central hole, and said disc includes eyelet means at said central hole for securing the projecting member of each of said portions together.

2. The invention according to claim 1 wherein the width of each projecting member is of the order of ½ inch at the outermost extent thereof.

3. The invention according to claim I including three projecting members mounted on each disc.

4. The invention according to claim 1 wherein the discs are spaced each from the next by spacer means such that the projecting members of one disc are spaced from the projecting members of the next adjacent disc.

5. The invention according to claim 1 wherein said means mounting said discs together includes a nut and bolt member with said bolt member passing through said discs and said nut and bolt member clamping said discs together to form said central hub.

6. The invention according to claim 5 wherein said bolt has a loop at a head end thereof.

7. The invention according to claim 5 wherein said nut includes means for attachment of said brush to a male coupling of a rod.

8. A brush for cleaning a chimney flue comprising a central hub portion arranged to extend longitudinally of a central axis of the chimney and a plurality of projecting members extending outwardly from the hub portion for engaging an inner surface of the flue, each of the projecting members comprising a strip of flexible plastics material having a width angularly of the axis greater than a thickness longitudinally of the axis and a length radially of the axis greater than the width thereof, said central hub portion and said projecting member being divided into a plurality of separate portions each portion having a central disc and a plurality of said projecting members extending outwardly from the disc substantially in the plane of the disc and equiangularly spaced around the disc, said central hub including means mounting said discs together in a stack such that each disc is prevented from rotating relative to a next adjacent disc and such that the projecting members of each disc are angularly offset from those of a next adjacent disc, each said projecting member having a curvature from an end thereof adjacent one disc to an outer end thereof in a direction out of radial plane of said central axis containing the disc such that each separate portion substantially lies in a cone shape with the portions having their cone shapes all directed in the same longitudinal direction along said central axis, wherein said disc and said plurality of projecting members extending outwardly from the disc are integrally molded and wherein said disc includes spacing means integrally molded therewith for spacing the projecting members thereof from the projecting members of the next adjacent disc and locking means integrally therewith for preventing angular rotation of the disc relative to the next adjacent disc.

9. The invention according to claim 8 including six projecting members arranged to project outwardly from each disc.

10. The invention according to claim 8 wherein said means for mounting said discs together includes a nut and bolt member with said bolt member passing through discs and said nut and bolt member clamping said discs together to form said central hub.

11. The invention according to claim 10 wherein said bolt has a loop at a head end thereof.

12. The invention according to claim 10 wherein said nut includes means for attachment of said brush to a male coupling of a rod.

* * * * *